United States Patent [19]

Spees

[11] 4,232,463

[45] Nov. 11, 1980

[54] PANEL FILE

[75] Inventor: Arthur T. Spees, Tustin, Calif.

[73] Assignee: Visu-Flex Corporation, Pico Rivera, Calif.

[21] Appl. No.: 906,917

[22] Filed: May 16, 1978

[51] Int. Cl.[3] ..... G09F 19/00

[52] U.S. Cl. ..... 40/373; 40/124.2; 40/159; 40/405

[58] Field of Search ..... 40/124, 124.2, 124.4, 40/405, 399, 391, 373, 158 R, 158 B, 159, 10 D, 10 R, 359, 360; 428/134, 136; 150/39

[56] References Cited

U.S. PATENT DOCUMENTS

| | | | |
|---|---|---|---|
| 679,734 | 8/1901 | Ely | 206/460 |
| 757,656 | 4/1904 | Scudder | 40/124.2 |
| 946,446 | 4/1910 | Leuthesser | 40/124.2 |
| 1,047,840 | 12/1912 | Reynolds | 40/124.2 |
| 1,320,683 | 11/1919 | Goodhue | 40/537 |
| 1,643,547 | 9/1927 | De Saussure, Jr. | 40/124.2 |
| 1,912,091 | 5/1933 | Pappalias | 40/124 |
| 1,980,241 | 11/1934 | Wilson et al. | 229/69 |
| 1,988,368 | 1/1935 | Ainsworth | 40/401 |
| 2,218,305 | 10/1940 | Ainsworth | 40/391 |
| 2,226,976 | 12/1940 | Leaming | 40/405 |
| 2,283,546 | 5/1942 | Fischer | 40/605 |
| 2,361,141 | 10/1944 | Woolf et al. | 206/482 |
| 2,429,349 | 10/1947 | Evans | 211/10 |
| 2,477,886 | 8/1949 | McCaskill | 40/405 X |
| 2,852,275 | 9/1958 | Brook | 281/31 |
| 2,959,879 | 11/1960 | Mazur | 40/124 |
| 3,073,050 | 1/1963 | DuBois | 40/124 |
| 3,220,133 | 11/1965 | Anderson et al. | 40/159 |
| 3,238,635 | 3/1966 | Engelstein | 40/159 |
| 3,280,820 | 10/1966 | Miller | 40/124.2 |
| 3,420,380 | 1/1969 | Jochim | 211/10 |
| 3,735,516 | 5/1973 | Wenstrom | 40/124.2 X |
| 3,759,305 | 9/1973 | McIntyre | 150/39 |
| 3,850,083 | 11/1974 | Falcon | 93/35 PC |
| 3,856,063 | 12/1974 | Dengel | 40/124.4 X |
| 4,008,742 | 2/1977 | Lemler | 40/124.2 X |
| 4,055,010 | 10/1977 | Fridlund et al. | 40/124 |
| 4,085,534 | 4/1978 | Eckstein et al. | 40/124.2 |
| 4,085,535 | 4/1978 | Schweinsberg | 40/124.2 |

FOREIGN PATENT DOCUMENTS

| | | | |
|---|---|---|---|
| 810870 | 6/1951 | Fed. Rep. of Germany . | |
| 1189049 | 3/1965 | Fed. Rep. of Germany | 40/373 |
| 1011400 | 6/1952 | France . | |
| 2285241 | 4/1976 | France | 40/124.2 |

*Primary Examiner*—Louis G. Mancene
*Assistant Examiner*—G. Lee Skillington
*Attorney, Agent, or Firm*—Knobbe, Martens, Olson, Hubbard & Bear

[57] ABSTRACT

A panel file, for the storage of flat, flexible data elements, consists of plural, vertically spaced pockets, the entrances of which are formed by a plurality of vertically spaced, horizontally extending strips of resilient material. The strips are arranged so as to have an upper edge which overlaps the lower portion of the next upwardly adjacent strip. The strips are fastened together at their lateral margins. The lower portions of the pockets are formed by a support sheet which is attached to the panel on the surface opposite the pocket entrances. The support sheet is cut so as to have a column of inverted "V"-shaped straps, each having a vertex which is attached to the back of strips above overlapped portions thereof. The strips have an upwardly indented bottom edge with a central vertex at the point where the support sheet strap is attached to the next downwardly adjacent strip. The attachment point between a strip and a strap is thus located in an area of the panel having the thickness of only one strip, which area is below the lower edge of an upwardly adjacent strip and above the upper edge of a downwardly adjacent strip. Thus constructed, the overlapping pocket entrances are individually openable, and do not become increasingly constrictive as the panel is filled. The panel thus constructed also has a minimum number of overlapping layers at any point.

27 Claims, 20 Drawing Figures

Fig. 1
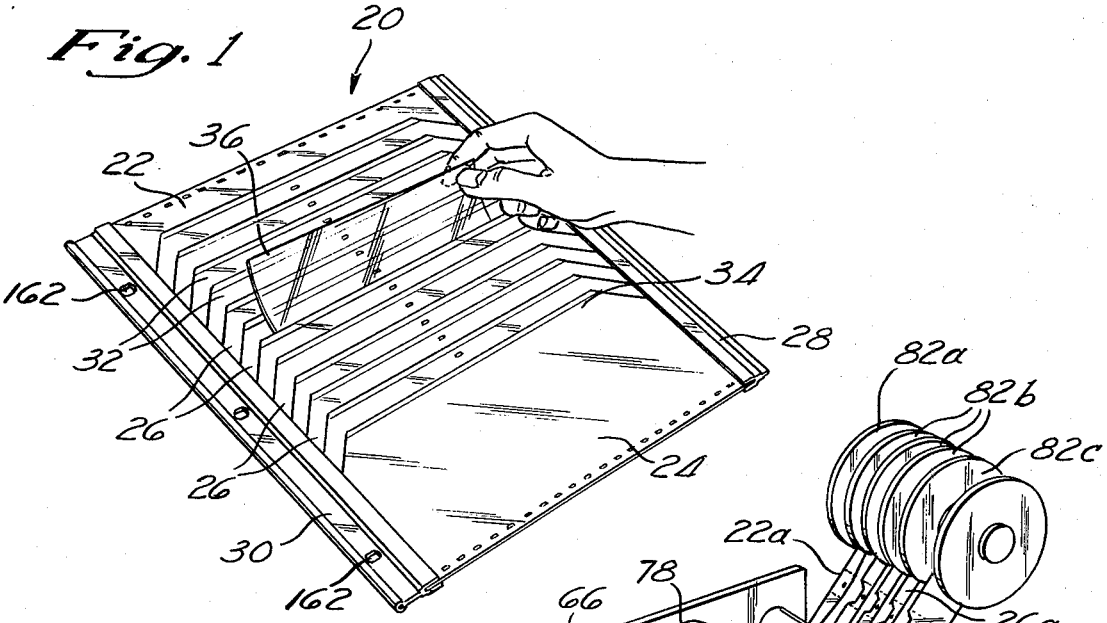
Fig. 2
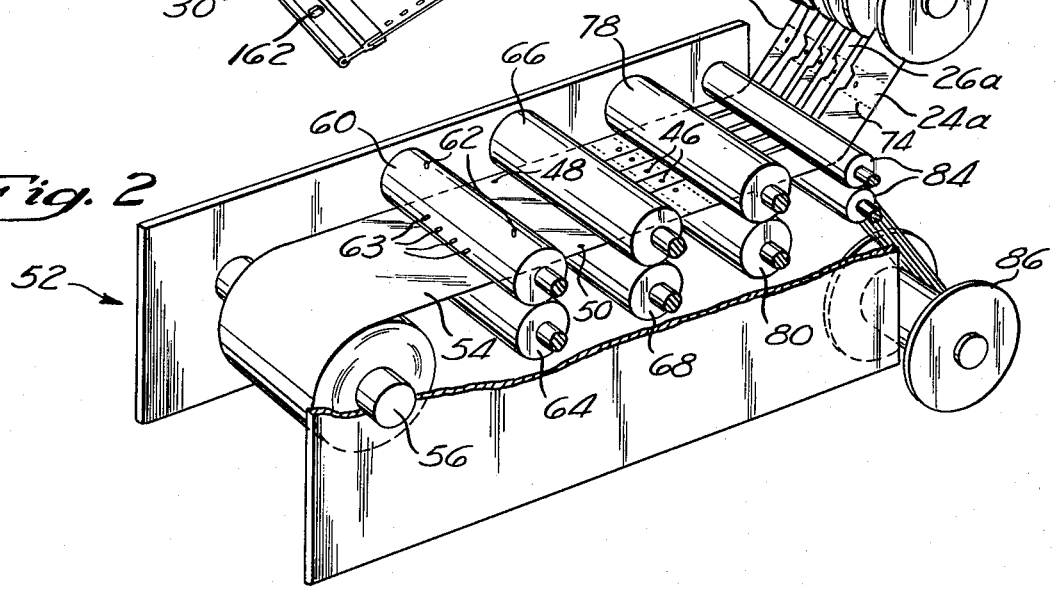
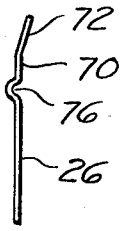
Fig. 4
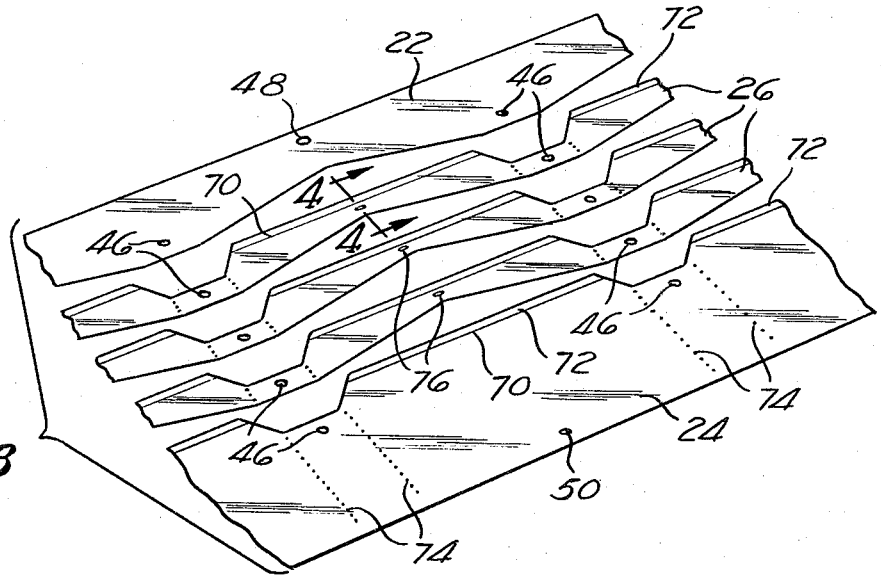
Fig. 3

Fig. 7
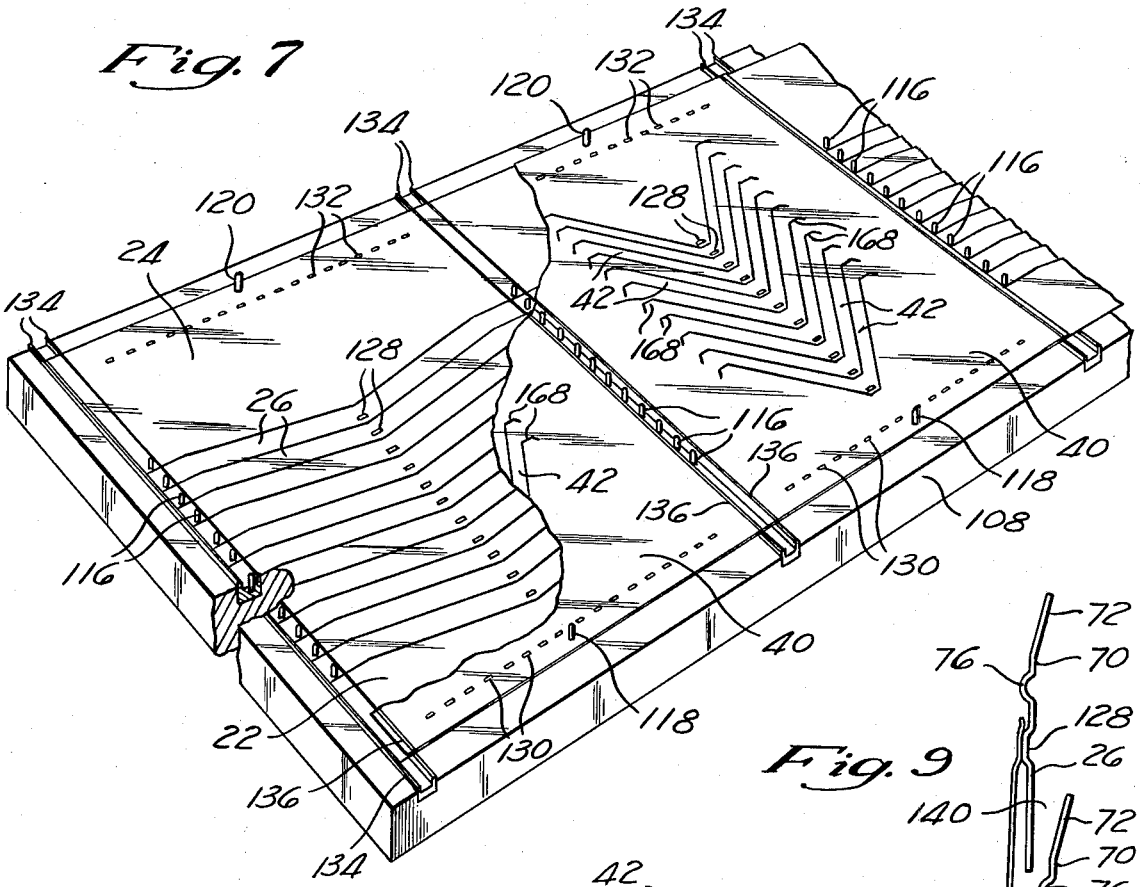
Fig. 9
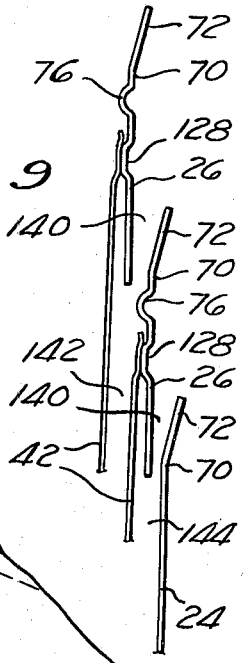
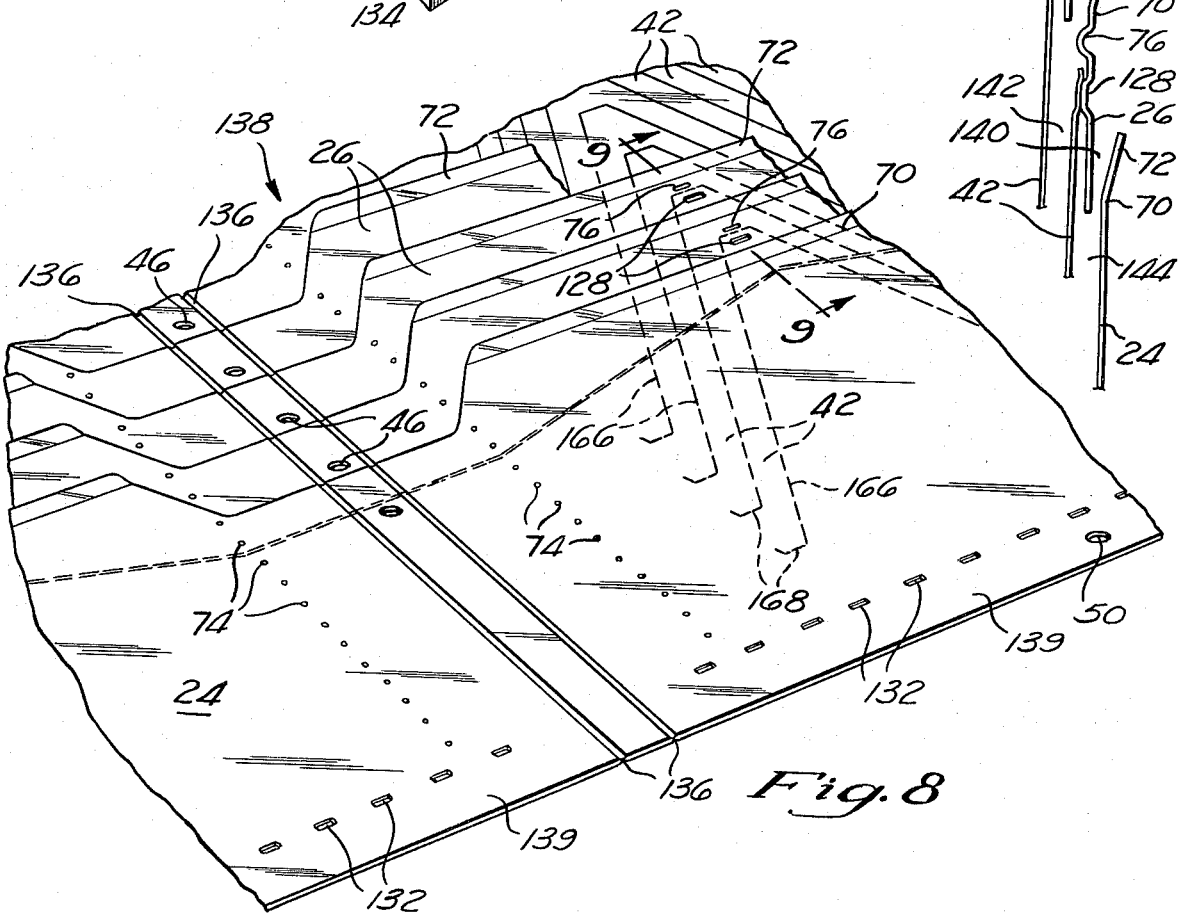
Fig. 8

Fig 10
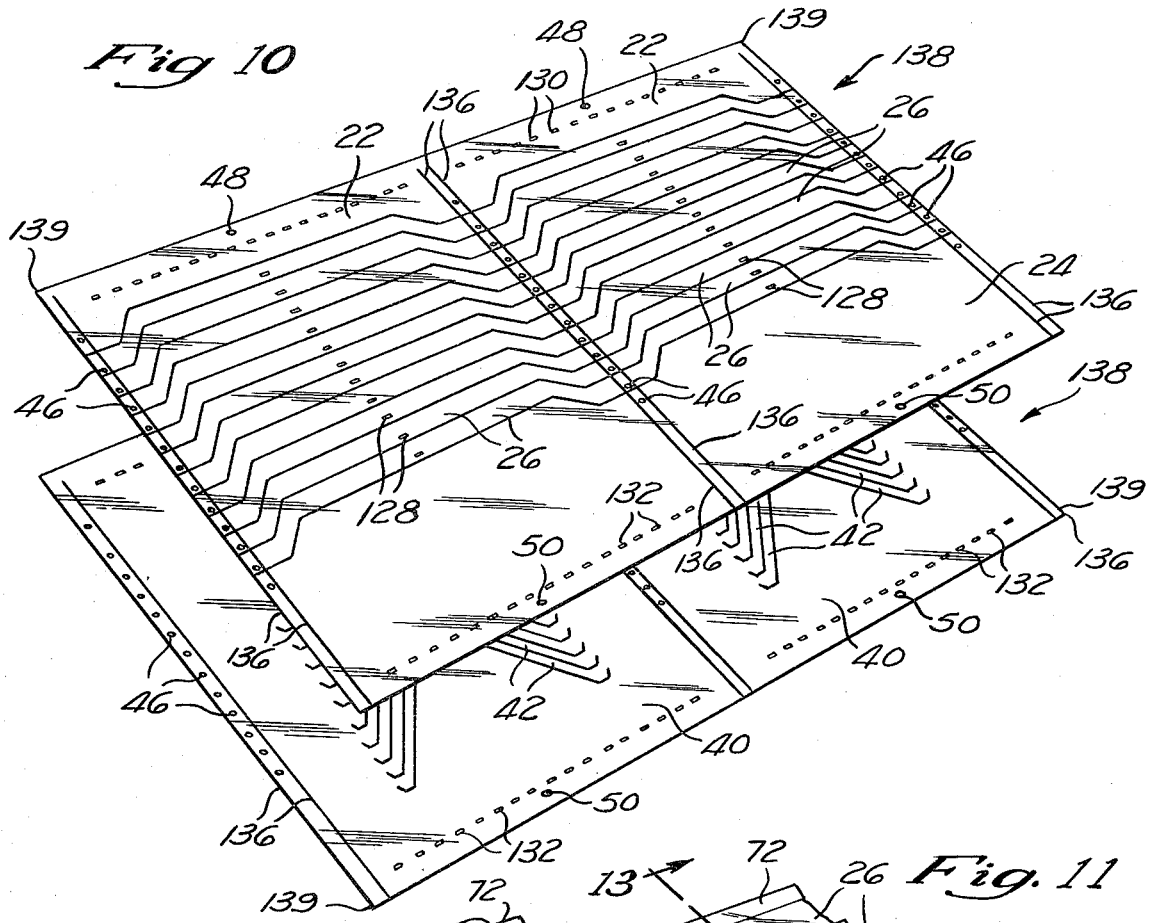
Fig. 11
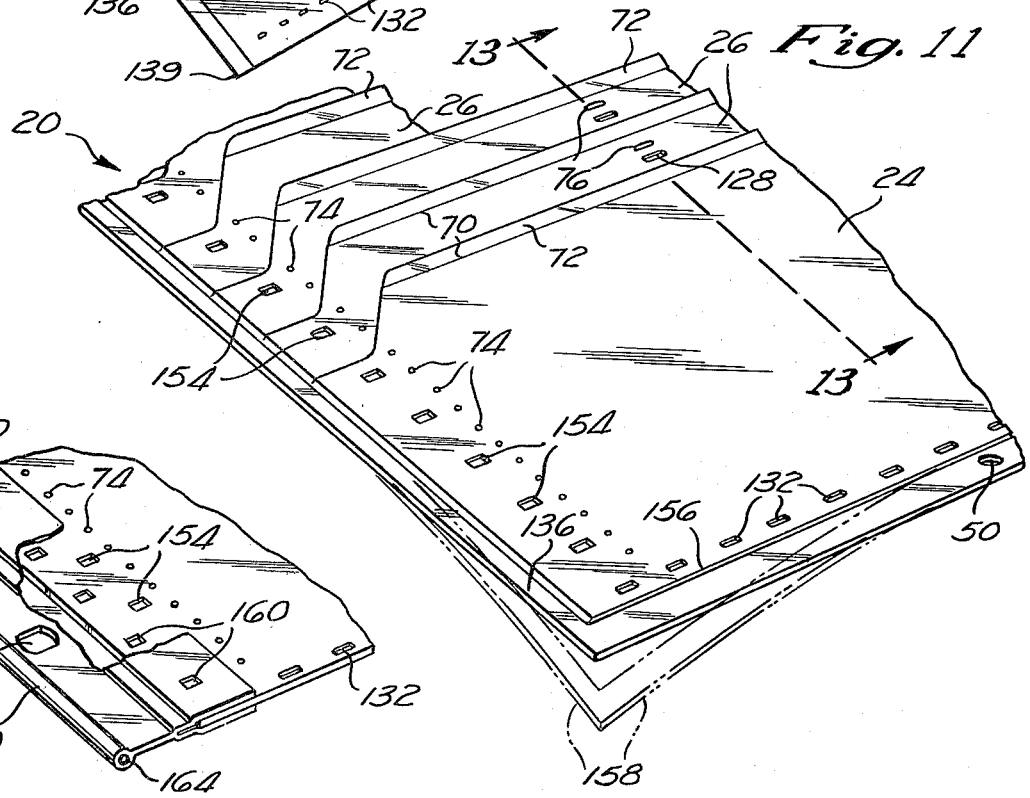
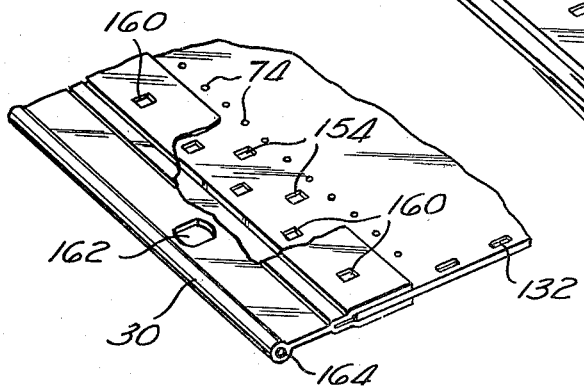
Fig. 12

17
18
19
26
42
42'
46
70
72
74
76
128
154
174
176
178
179
180
186
188
190
192
194
196

PANEL FILE

BACKGROUND OF THE INVENTION

The present invention relates to a device for the storage of flat, flexible data cards in a manner which allows easy access and retrieval. In particular, the invention relates to the storage of microfiche in a panel having multiple individual pockets, and to the method of manufacture of such a panel.

The storage of data on microfiche has, in recent years, become increasingly popular. As a result, various means have been devised for the storage of microfiche, and such devices have met with varying degrees of success. One particularly popular type of storage device is that which is commonly known as a panel file. Such panel files generally consist of a plurality of panels or frames, each having multiple individual pockets for the placement of microfiche, with the panels being adaptable for storage in a ring binder or a rotary stand.

The utility of such panel files, however, has been limited to some extent by a number of disadvantages. For example, one common type of panel file comprises a number of vertically spaced overlapping solid panes of material arranged to form a vertically disposed overlapping series of pockets. The primary disadvantage of such a panel file is inherent in the fact that such a construction provides a relatively thick and bulky panel, thus limiting the number of such panels which can be placed in a ring binder or on a rotary stand. Furthermore, panels constructed in this manner tend to constrict the microfiche progressively more tightly as more and more microfiche elements are inserted in the pockets. This feature makes insertion and removal of microfiche elements increasingly difficult as the panel is filled towards it ultimate capacity, thereby making its use more cumbersome and also increasing the probability of scratching or marring the microfiche data elements during the insertion or removal process. Furthermore, the formation of pockets which are constructed with solid panes of material front and back tends to trap dirt and abrasive material which harm delicate microfiche during the insertion or removal process.

Two variations of another type of panel file are disclosed in U.S. Pat. No. 2,959,897 to Mazur and U.S. Pat. No. 4,055,010 to Fridlund et al. A feature which is common to both of these designs is the formation of pocket entrances by means of cutting horizontal slits into a sheet of material. While such a feature allows the construction of a thinner, less bulky panel file, this result is accomplished at the expense of structural strength. Thus, panel files constructed in accordance with the teachings of Mazur or Fridlund patents may exhibit a tendency to tear, and therefore lack durability. In addition, the failure of these panels to provide an entrance channel bounded by overlapping sheets makes insertion of data elements difficult.

Hence, there has been a need for a file panel which combines strength and durability with a thin profile and easy data element insertion and that is not prone to excessively tight packing and scratching of the microfiche as the file is filled to capacity.

SUMMARY OF THE INVENTION

The present invention consists of a panel file for microfiche and like data elements, and which has a unique and novel construction which allows for a thin, lightweight profile while maintaining structural strength and durability and easy insertion and removal of the data elements without abrasion thereof even when filled to capacity.

The panel consists of plural, vertically extending, overlapping pockets, the upper margins of which are formed by a plurality of vertically spaced, horizontally extending strips of resilient material such as a plastic or vinyl. The margin strips are arranged so that all but the upper-most strip on the panel have an upper edge which overlaps the lower portion of the next upwardly adjacent margin strip. The upper edges of the margin strips taper downwardly at the sides where the strips are fastened together, preferably by a welding process, to form a series of individual overlapping pocket entrances.

The lower portions of the pockets are formed by a pocket forming support sheet which is attached to the panel on the surface opposite the overlapping pocket entrances. The pocket forming support sheet consists of a thin sheet of flexible material such as plastic or vinyl which is cut so as to have at least one vertical column of inverted V-shaped straps. Each strap has a vertex which is attached, as by a spot weld, to the back of one of the upper-margin-forming strips. The strips are cut so as to have an upwardly concave bottom edge with a central vertex at the point where the support sheet strap is attached to the next downwardly adjacent margin strip. Thus, the attachement point between a margin strip and a pocket forming strap is located in an area of the panel where there is only a single thickness of upper margin material, i.e., the thickness of one margin strip. This area where the attachment point is located is also, by this configuration, below the lower edge of an upwardly adjacent margin strip and above the upper edge of a downwardly adjacent margin strip.

Thus constructed, the panel has a vertically disposed array of individual overlapping pockets. The pockets are individually openable and, since the margins are formed of strips rather than solid panes, the pockets do not become increasingly constrictive as the panel is filled. Furthermore, the formation of the pocket entrances with relatively narrow strips, rather than wide solid panes, minimizes the number of overlapping layers at any point in the panel, thus contributing to the thin profile of the finished panel.

The file panel is constructed with a process having essentially two stages. In the first stage, a continuous solid sheet of material is fed into a punching, embossing and cutting machine which converts the sheet into several continuous rolls of serially attached, finished margin strip elements. In the second stage of manufacture, reels containing the rolls of continuously attached margin strip elements are placed on a rack which positions them for alignment and feeding into a sealing machine. The continuous rolls of strip elements are fed from the reels, through a system of aligned rollers, into a strip aligner to position them in the proper overlapping alignment. The strips, which are, at this point in the process, in the form of continuous tapes, are then successively fed through an accumulater, a strip locking device which locks the strips into proper alignment, a second strip aligner, and finally onto a heat sealing die. The pocket forming support sheet is then positioned on top of the assembled, overlapping margin strips on the die. The panel is now ready for the first sealing operation which seals the margin strips to the individual support straps on the center support sheet. Vertical tear seals along the lateral edges of the panel are also created at this point in the process.

Upon completion of this sealing operation, one side of a panel has been created, with the center support sheet and margin strips having been sealed together. The tear seals along the vertical margins of each panel permit the panels to be easily torn apart from adjacent material. Because the continuous tapes of margin strips are fed into the machine in exact registration, this first sealing operation permanently attaches the margin strips to one another in precise alignment and registration.

In the production process, the operator tears off a segment containing two of these sealed half panels and advances new margin strip tapes to place them into position over registration pins in the first sealing die. Each new group of margin strips is secured into position over the sealing die, a strip lock is activated, and the die advances to a sealing position. This advancement causes additional margin strip material (equal to the length of the die) to be pulled from the reels. With the completion of another sealing operation, the die, the strip lock and the second strip aligner return to their original position, with the excess material just removed from the payoff reels dropping down into the accumulator. Again, two half panels have been completed and are torn off at the rear-most tear seal. The operation is repeated, with the strip lock being released, permitting the operator freely to pull the material stored in the accumulator through the strip aligners into position over the dies for the sealing operation. Again, the locking device is locked, securing all strips in position, and the locking device, together with the second strip aligner and die, advances to the sealing position, pulling the required length of additional material off the payoff reels.

A pair of completed two half-panel segments formed by this process are then placed in opposing positions on a second die so that the upper pocket margins face outwardly with the two center support sheets abutted. The final sealing operation then takes place in which support seals are made through all the complete sandwiched material, with the exception of the center support sheets, and a final perimeter tear seal is made, at which the scrap material is torn off. Finally, extruded side margin elements are attached to the lateral margins of the finished panel file by means of heat seals.

BRIEF DESCRIPTION OF THE DRAWINGS

FIG. 1 is a top perspective view of the completed panel file showing the insertion of a data element in one of the pockets;

FIG. 2 is a top perspective schematic view of the machine used in the first stage of the manufacture of the panel file;

FIG. 3 is a top perspective view of the finished strip elements produced by the first stage in the manufacturing process;

FIG. 4 is a cross-sectional view taken along line 4—4 of FIG. 3;

FIG. 7 is a top perspective view, partially cut away, of the first stage sealing die used in the machine illustrated in FIG. 5, along with the panel file elements placed thereon after sealing;

FIG. 8 is a fragmentary top perspective view of two half-panel segments after removal from the die shown in FIG. 7;

FIG. 9 is a cross-sectional view along the line 9—9 of FIG. 8;

FIG. 10 is a top perspective exploded view showing the positioning of a pair of completed two half-panel segments prior to the attachment of these segments to one another;

FIG. 11 is a fragmentary top perspective view of a panel after completion of the final sealing step, showing the removal of the scrap strips;

FIG. 12 is a fragmentary top perspective view of a completed panel file, showing the details of the extruded margin strip;

Figure 14:
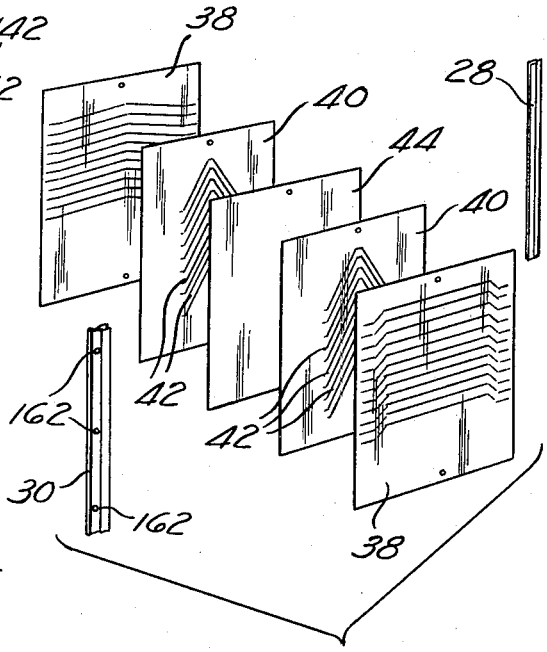
Figure 15:
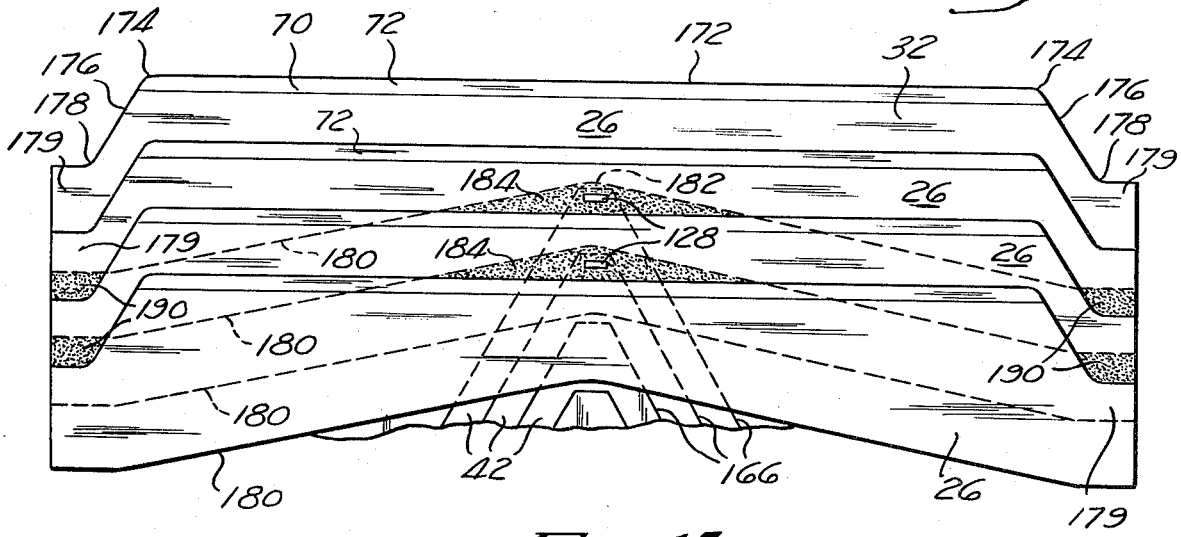
Figures 16, 17, 18, 19:
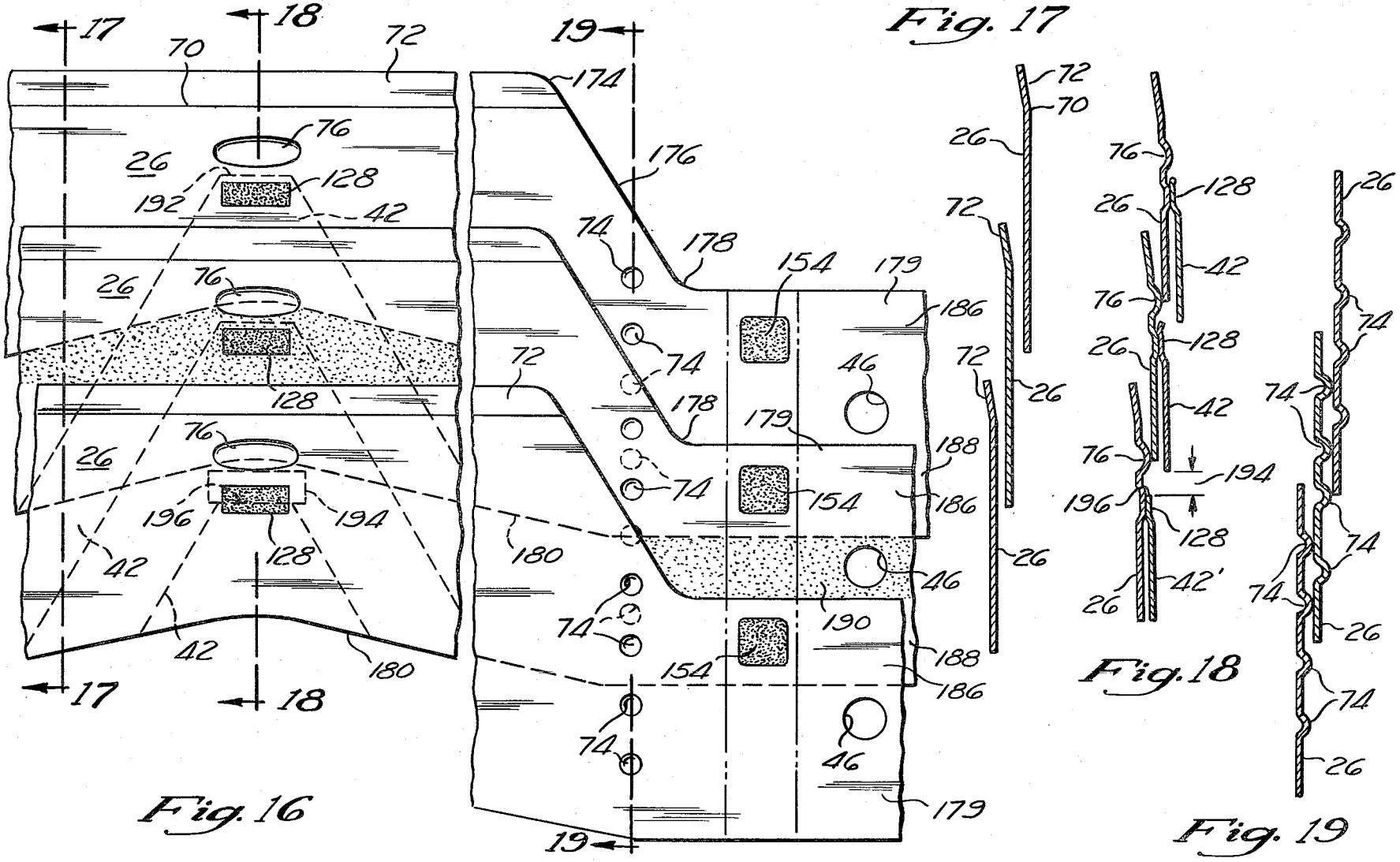

FIG. **13*a* is also a fragmentary cross-sectional view along line 13—13 of FIg. 11**, showing the use of an optical center divider sheet;

FIG. 14 is an exploded front perspective view showing the basic elements of a completed panel file;

FIG. 15 is a top plan view of the panel file of the present invention showing the spatial relationships among adjacent overlapping margin strips, and detailing the attachment of the pocket forming support sheet to the strips;

FIG. 16 is an enlarged fragmentary top plan view of the panel file of the present invention showing further details of the margin strips and pocket forming support sheet;

FIG. 17 is a cross-sectional view along line 17—17 of FIG. 16;

FIG. 18 is a cross-sectional view along line 18—18 of FIG. 16; and

FIG. 19 is a cross-sectional view along line 19—19 of FIG. 16.

DETAILED DESCRIPTION OF THE INVENTION

Referring first to FIG. 1, a completely assembled panel file 20 as constructed in accordance with the present invention is shown. The panel file 20 comprises three basic types of upper margin strip elements: a top margin strip 22, a bottom margin strip 24 and a plurality of central margin strips 26. The lateral edges of the strips 22, 24, and 26 are covered by a pair of extruded edge channels 28 and 30 and are spaced to vertically overlap in the panel, with the center margin strips 26 and the bottom margin strip 24 having upper flaps 32 and 34, respectively, which overlap the bottom edge of the next upwardly adjacent strip. As shown, a data element card such as a microfiche 36 may be inserted between two adjacent overlapping margin strips and into the pocket formed therebetween.

Referring now to FIG. 14, it is seen that the panel file 20 of FIG. 1 comprises a sandwich of several layers. The outer-most layers are a pair of pocket entrance or upper margin panels 38 formed by the overlapping margin strips 22, 24, and 26. The inner layers comprise a pair of pocket forming support sheets 40 which are pre-cut to include a central vertical column of inverted V-shaped pocket forming straps 42. An optional semi-rigid center divider sheet 44 may also be incorporated as the inner-most layer of the sandwich.

FIG. 3 shows the details of the design of the margin strips 22, 24, and 26. Each of the margin strips 22, 24, and 26 has a pair of alignment apertures 46 at opposite ends of the strip for the purpose of alignment with other strips during the assembly process. The top margin strip 22 has an alignment aperture 48 centrally located proximate its upper edge and the bottom margin strip 24 has an alignment aperture 50 centrally located proximate its bottom edge. The alignment apertures 48 and 50 are used to align the center pocket forming sheet 40 with the pocket entrance panels 38 (FIG. 14) during the assembly operations which will be presently described.

A machine 52 for forming the margin strips of FIG. 3 is illustrated in FIG. 2. The machine 52 works on a continuous feed principle wherein a sheet 54 of margin strip-forming material is fed continuously to sequential margin strip forming operations. The material is supplied from a feed mandril 56 to the first operating station which consists of an upper male punching die roller 60 having plural aligned and spaced punches 62. The sheet of material 54 is fed between the upper male punching die roller 60 and a lower female punching die roller 64. As the upper roller 60 rotates, the punches 62 punch the alignment apertures 46, 48, and 50 (FIG. 3) into the margin strip material. The material sheet 54 is then fed into the second operating station of the machine wherein the sheet is engaged between an upper embossing roller 66 and a second lower roller 68 having a resilient surface. The embossing roller 66 places a continuous score line 70 (FIGS. 3 and 4) along the upper edges of the center margin strips 26 and the lower margin strip 24. The score 70 provides a slightly outwardly turned lip 72 on the center margin strips and the lower margin strips to facilitate insertion and removal of the data elements 36. The embossing roller 66 also provides a pair of longitudinal columns of spacing embossment 74 along the lateral edges of the center and bottom margin strips. The spacing embossments 74 serve to slightly space apart adjacent margin strips as well as pocket entrances formed thereby to facilitate data card insertion and to minimize scratching of microfiche. No scores or embossments are required on the upper strip 22. The embossing roller 66 also embosses a small dimple or protuberance 76 at the center line of the center strip 26 just below the scoring line 70. The dimple 76 serves to facilitate the insertion of a data element card into the file panel as will be subsequently described.

After embossing, the sheet 54 is fed into the third operating station of the machine 52. This station consists of an upper cutting die roller 78 which engages the sheet 54 against a lower hard surfaced roller 80. The cutting die roller 78 cuts the sheet laterally into continuous tapes of serially attached strip elements in the configuration shown in FIG. 3. Thus, there will be one tape 22*a* of serially connected top margin strips 22, three tapes 26*a* of serially connected center margin strips 26 and one tape 24*a* of serially connected bottom margin strips 24. These tapes are respectively taken up on take-up reels 82*a*, 82*b*, and 82*c* after the sheet has passed through a pair of pinch rollers 84, after which the tapes are separated from the scrap. The scrap is collected on a scrap reel 86 for eventual disposal.

The strip forming machine 52 is preferably run in two modes. In one mode, the mode just described, the machine will form one reel of top margin strips, three reels of center margin strips, and one reel of bottom margin strips. In the second mode, a narrower sheet 54 of material is loaded on the mandril 56 so that only the center portions of the rollers 60, 66, and 78 are used, thereby forming only center margin strips 26. By way of specific example, if a panel file is desired which has fifteen center margin strips 26, one run will be made in the first mode with a relatively wide sheet 54 to make a top margin strip 22, a bottom margin strip 24, and three center margin strips 26. Subsequently, four runs will be made in the second mode with a narrower sheet 54 wherein three center margin strips 26 will be made in each run.

In order to ensure the proper alignment of the apertures made by the punching die roller 60, the embossments made by the embossing roller 66 and the cuts made by the cutting die roller 78, the sheet 54 is kept taut and in precise registration between the respective operating stations in the machine 52. Furthermore, the rollers 60, 66, and 78 are interconnected, as by gears (not shown) to ensure the proper timing of the sequential operations.

Figure 5:
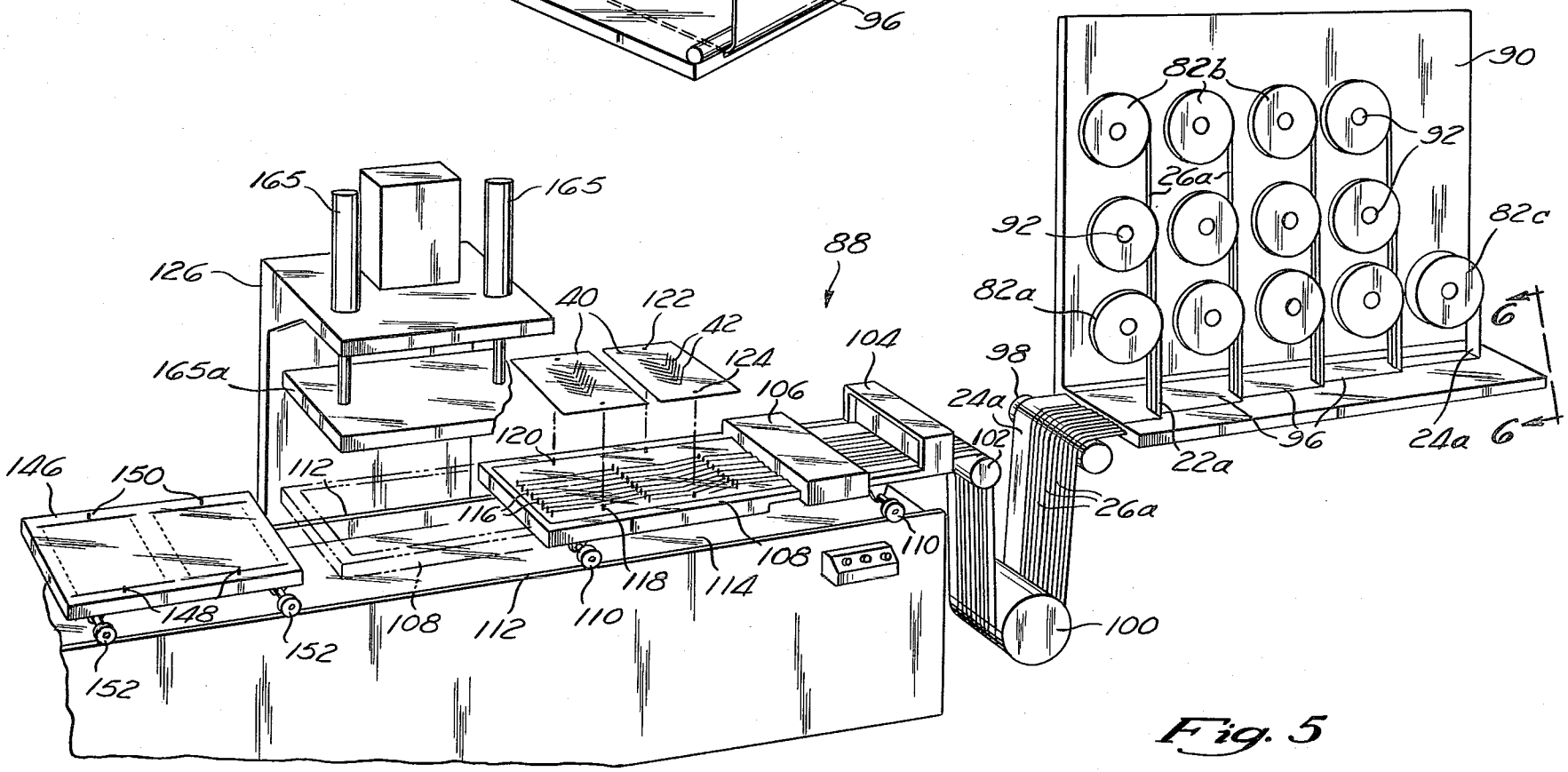
FIG. 5 is a perspective schematic view of the machine used in the second stage of the manufacturing process for the panel file.

The second stage of the manufacturing process is performed on a panel forming machine 88 as illustrated in FIG. 5. The panel forming machine 88 has a loading station consisting of an upright wall 90 on which is mounted an array of reel hubs 92 on which are placed the reels 82*a*, 82*b*, and 82*c* taken from the margin strip forming machine 52. The reel hubs 92 are staggered so that when the reels 82*a*, 82*b*, and 82*c* are placed thereon in their appropriate locations, the strip tapes 22*a*, 24*a*, and 26*a* will be appropriately located for proper alignment into their parallel overlapping relationships. To this end, it is advantageous to place the reel 82*a* containing the strip tape 22*a* corresponding to the top margin strip 22 on the hub 92 which is spaced furthest from the wall 90 and the reel 82*c* carrying the strip tape 24*a* corresponding to the bottom margin strip 24 on the reel hub 92 which is spaced closest to the wall 90. The remaining reel hubs 92 would thus carry the reels 82*b* containing the strip tapes 26*a* corresponding to the plural center margin strips 26.

Figure 6:
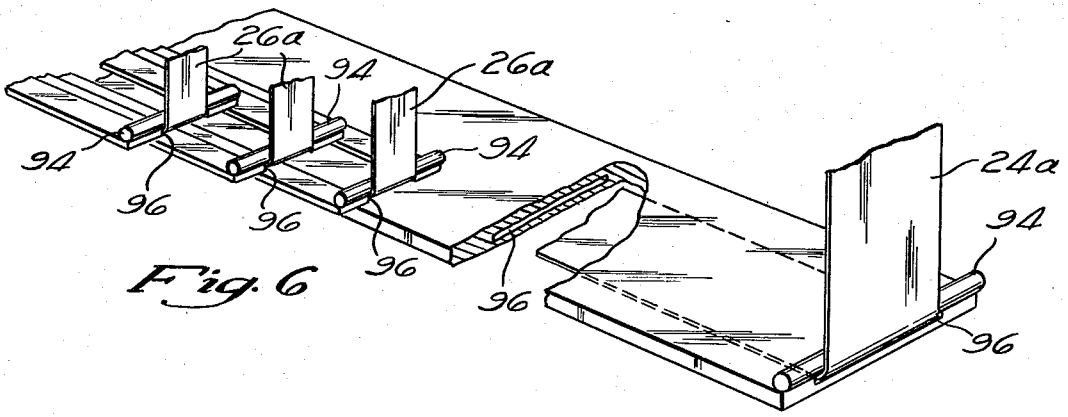
FIG. 6 is a fragmentary perspective schematic view, partially in section, of the strip alignment mechanism of the machine illustrated in FIG. 5, taken along line 6—6 of FIG. 5.

As shown in FIG. 6, the strip tapes from the reels are then fed over rollers 94 and into a first array of parallel strip alignment channels 96 directly adjacent to the upright wall 90. The channels 96 are only as wide as the widest part of the strip which passes through it, and the channels 96 are adjoined in an overlapping relationship which corresponds to the desired overlapping relationship among the strips. Thus, the strips emerge from the channels 96 in their proper overlapping alignment.

Referring to FIGS. 5 and 7, the prealigned strips are fed from the channels 96 over a first fixed roller 98 and down under an accumulator roller 100 which is unsupported except by the strips. From the accumulator roller 100 the strips travel upwardly over a second fixed roller 102. Thus, path of travel for the strips in the machine 88 between the first fixed roller 98 and the second fixed roller 102 may be termed an accumulator, the function of which will shortly become apparent. The strips then pass through a strip locking device 104, which consists of a mechanically or hydraulically actuated clamp, having a soft clamping surface, which locks the strips received from the accumulator into their proper alignment. From the strip lock 104, the strips pass through a second array 106 of strip alignment channels 96, which is similar in all material respects to the first array, and which maintains the proper overlapping alignment among the respective strips as they are received from the locking device 104. From the alignment section 106, the strips are pulled onto a first heat sealing die 108. The locking device 104, the alignment section 106, and the die 108 are rigidly connected as an integral unit which is mounted on rollers 110 riding tracks 112 located on a machine bed 114.

The heat sealing die 108 includes columns of spring loaded, lateral margin locating pins 116 which are registerable with the lateral margin locating apertures 46 (FIG. 3) in the margin strips. The die is also provided with a top margin locating pin 118 which is registerable with the top margin locating aperture 48 (FIG. 3) in the top margin strip 22 and a bottom margin locating pin 120 which is registerable with the bottom margin locating aperture 50 (FIG. 3) in the bottom margin strip 24. The registering of the respective locating pins and locating apertures positively positions the lateral and vertical alignment of the strips on the die 108.

The die 108 is wide enough to accommodate a length of strip tape sufficient to form two panels. A pocket forming center support sheet 40, pre-cut to have a central column of inverted V-shaped straps 42, is placed on top of the strips on the die and located by means of a bottom locating aperture 122 and a top locating aperture 124 which register with the locating pins 120 and 118, respectively. In this manner, two of the pocket forming center support sheets 40 are placed side by side over the strips in the die, as shown most clearly in FIG. 7.

Panels, aligned on the die 108, are now ready for sealing. The strip lock 104 is activated, clamping the strips into their proper alignment. The die 108 is advanced along the track 112 into position underneath a radio frequency (RF) sealing unit 126, the advancement of the die 108 pulling another two-panel length of strip tapes through the accumulator 100 from the reels 82.

The RF sealing unit 126 seals the strips to each other and seals the pocket forming support sheet 40 to the strips. The panel assembly after the first sealing stage is shown most clearly in FIG. 7. As can be seen, the pins 116, 118, and 120, which retract into the die 108 during the sealing process, precisely align the strips in the proper lateral and vertical relationships, among themselves and between the strips and the pocket forming sheet so that the vertex of each of the straps 42 is attached to the back of an adjacent center margin strip 26 by means of a spot weld 128 located just below the embossment 76 as shown most clearly in FIGS. 8 and 9. Thus, it can be seen that the embossment 76 serves the purpose of guiding a data card over the spot weld 128 as the data card is inserted under the outwardly extending flange 72. It is important that the spot welds 128 be as close to the tip of the vertex of the straps 42 as possible or else a tab would be formed that would extend into the pocket which would interfere with the insertion of a data element.

A line of spot welds 130 is formed across the top of the panel, and a similar line of spot welds 132 is formed across the bottom of the panel to attach the center support sheet 40 to the top strip 22 and the bottom strip 24, respectively. Longitudinal die edges or knives 134 in the die 108 form longitudinal tear seals 136 along the lateral margins of the panels.

At this point an attached pair 138 of completed panel halves 139 have been formed on the die 108. Referring again to FIG. 5, the die 108 along with the alignment device 106 and the strip lock 104 are now returned to their original position and the fresh strips, which had been advanced from the reels 82*a*, 82*b*, and 82*c* during the forward movement of the die assembly, drop down into the accumulator 100. The attached pair 138 of completed panel halves 139 are then removed from the die 108 by the operator, who tears the pair off along one of the tear seals 136 at the trailing edge of the pair 138. The strip lock 104 is now unlocked and the fresh strips are advanced from the accumulator 100 through the locking device 104 and the alignment device 106 and onto the die 108 as before.

As clearly seen in FIGS. 8 and 9, the strips 22, 24, and 26 form the pocket entrance panel comprising an array of vertically spaced overlapping pocket entrance channels 140, while a series of vertically spaced overlapping pockets 142 are created between adjacent straps 42. A bottom pocket 144 is created between the backing sheet 40 and the bottom strip 24, the welds 132 forming the pocket bottom.

A second sealing process is now performed. As shown in FIG. 10, two pairs 138 of attached panel halves 139 are placed in an opposing relationship with the overlapping strips forming the pocket entrances 140 outer-most and the pocket forming sheets 40 inner-most. Referring to FIG. 5, the two opposing pairs 138 of panel halves 139 (FIG. 10) are then placed on a second die 146. The second die 146 is provided with spring loaded top locating pins 148 and bottom locating pins 150 which register with the locating apertures 48 and 50, respectively, in the panel halves 139 to maintain the proper relationship of the panels on the die. The second die 146 is provided with rollers 152 which ride on the track 112, and is thus movable into position under the sealing unit from the end of the machine bed 114 opposite the first die 108.

The die 146 and sealing unit 126 create plural lateral margin spot welds 154, best shown in FIG. 11. The spot welds 154 are formed between two adjacent margin strips 26 where they overlap at their lateral margins, just outwardly of the column of the spacing embossments 74. During the second sealing process, a perimeter tear seal 156 is also made joining the two pairs 138 of attached panel halves 139 together to form an attached pair of full panels 20, leaving a perimeter scrap strip 158. The second die 146 is then wheeled back to its original position, the attached pairs of panels 20 are removed, and the perimeter scrap strip 158 is peeled off along the perimeter strip seal 156.

The attached panel pairs are then separated into separate panels 20 along the central longitudinal tear seals 136. The extruded edge channels 28 and 30 are then attached to the lateral margins of the panel 20 by means of a column of heat seals 160 provided by a third die (not shown) in the sealing unit 126. As seen most clearly in FIG. 12, the edge channel 30 is provided with three apertures 162 suitably spaced to fit a three-ring binder. Furthermore, the outer margin of the edge channel 30 is provided with a longitudinal bore 164 which can accommodate the rod of a pivot stand. Various other mounting devices may be easily incorporated in the channels 28 and 30, or elsewhere on the panel 20, as will be apparent to those skilled in this art.

The entire manufacturing process described above may be automated in part or in its entirety. For example, the strips may be advanced onto the die 108 automatically or manually, and the dies 108 and 146 are preferably moved by motorized means (not shown). The other operative parts of the machine 88, such as the locking device 104, may also be automated by suitable means, and proper sequencing of the operations performed on the machine 88 may be achieved by any of several conventional sequencing mechanisms, as are well known in the art.

Furthermore, the RF sealing unit 126 may be one of any of several conventional designs. For example, the sealing unit 126 shown in FIG. 5 is a hydraulic press type, having a pair of hydraulic cylinders 165 which raise and lower a flat sealing plate 165*a*, which is pressed against the dies 108 and 146.

Having described the process for forming the panel 20, the details of construction thereof may now be explained. Referring once again to FIG. 8, the pocket forming center support sheet 40 includes inverted V-shaped pocket forming straps 42, formed by a plurality of inverted V-shaped cuts 166. Each cut 166 terminates at its two lower-most extremities in an upwardly turned, hook-shaped section 168. The lower ends of two adjacent inverted V-shaped straps form the bottom of each individual pocket, while the hooked section 168 inhibits the tearing of the straps 42 during repeated use. Although a single column of inverted V-shaped straps 42 is considered to be optimal, the straps may be formed in other shapes, such as, for example, arches, and may be used in plural vertical columns. In any case, the hook-shaped bend 168 in the cuts 166 would preferably be used to inhibit tearing.

Figure 13:
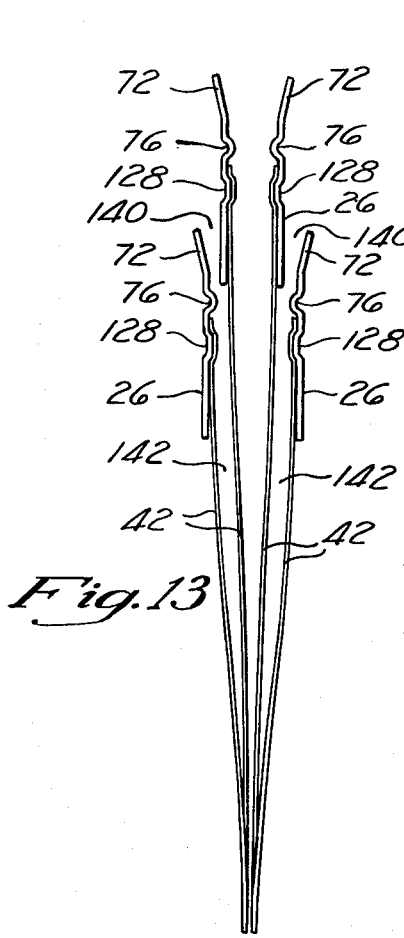
FIG. 13 is a fragmentary cross-sectional view along line 13—13 of FIG. 11.

The formation of the pockets 142 and the pocket entrances 140 by the margin strips 26 and the straps 42 is most clearly illustrated in FIG. 13. As can be seen, the panel has pocket entrances 140 on both sides. The pocket entrances 140 are formed between the upper edge, including the outwardly turned lip 72, of a lower margin strip and the lower portion of an upper margin strip. Directly below the overlapping portions of the adjacent strips is the embossment 76 on the lower strip. As mentioned before, the embossment 76 serves to guide a data element 36 (FIG. 1) over the spot weld 128 between the strip and a pocket forming strap 42. Two adjacent straps 42 form the pocket 142 in which the data element is stored, with the lower ends of the two adjacent straps forming the bottom of the pocket 142.

Figure 13A:
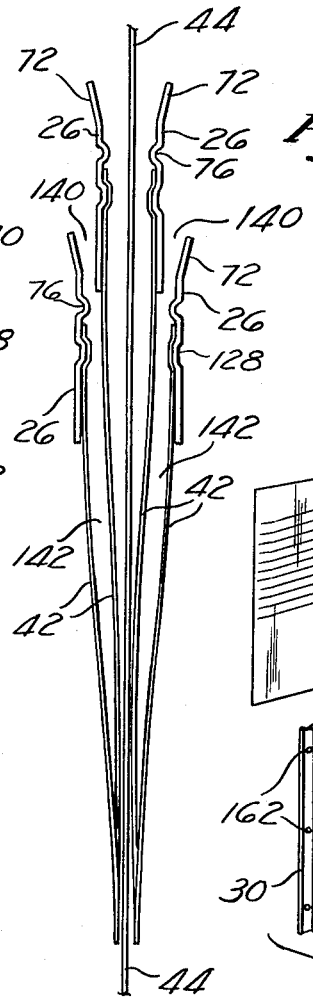

FIG. 13*a* shows an alternative embodiment in which the optional center divider sheet 44 is used as a means of adding a further degree of strength and rigidity to the panel. In this embodiment, the divider sheet 44 is placed between the attached pairs 138 of panel halves 139 on the second die 146. The second sealing process then seals the center divider sheet 44 as well as all layers of the two attached panels which are thereby formed. Those skilled in this art will recognize that, when a one-sided panel is manufactured according to this invention, the divider sheet 44 becomes a back cover, and is often desirable for protecting stored data cards.

Reference should now be made to FIGS. 15 through 19 for important details of the panel structure. FIG. 15 shows several adjacent center margin strips 26 in their overlapping relationship. The upper edge of each margin strip 26 has a long straight center section 172. The upper edge then slopes downwardly at the sides, beginning at a pair of upper bends 174 which form downwardly sloping lateral portions 176. Each of the downwardly sloping portions 176 terminates at a lower bend 178 from which the upper margin of the strip again extends straight horizontally into a horizontal lateral tab 179. This configuration provides the overlapping portion of each margin strip with a substantial area which is not directly attached to the sides of the panel, thus creating the flap 32 which can be pulled away from the panel to enlarge the pocket entrance 140. Thus, the upper portions of the strips have greater flexibility than they would have if the strips had straight horizontal upper edges, so that the data elements may be more easily inserted into the pocket entrances 140 without undue constriction and tightness between the data elements and the strips.

Each of the margin strips has a lower edge 180 which is cut upwardly towards the center from each side to form an obtuse angular concavity. The bottom edge 180 thus has a concave vertex 182 at the center. This configuration of the bottom edge 180 provides a central column of areas 184 (shaded in FIG. 15) where there is the thickness of only a single margin strip overlying the pocket forming support sheet 40. Thus, it can be seen that the bottom edge configuration shown allows the spot weld 128 to be made between a strap 42 and the back of only one margin strip 26. If the lower margin 180 of the strips did not have this configuration, it will be seen that the spot welds 128 would cause the welding together of two adjacent margin strips, thereby defeating the purpose of the invention.

As shown most clearly in FIG. 16, the parallel horizontal lateral tabs 179 of the margin strips have an upper portion 186 which overlaps a lower portion 188 of the next upwardly adjacent margin strip. In between the upper portion 186 and the lower portion 188 of each center margin strip 26 is a middle portion 190 which neither overlaps nor is overlapped by an adjacent strip. Thus, the pocket entrance forming panel 38 will have but a single thickness of material at each of the areas 190, a longitudinal column of which will occur along each of the lateral margins of the panel. As can be seen in FIG. 16, the alignment apertures 46 are conveniently located in the single thickness areas 190, so that only a single pair of alignment apertures 46 is needed on each strip.

Another feature which is evident in FIG. 16 is the longitudinal column of spacing embossments 74. As can be seen, these spacing embossments 74 are located just inwardly of the lower bend 178 in the upper margin. As previously mentioned, the spacing embossments 74 provide a narrow gap between overlapping portions of adjacent strips so as to provide space for a data element between the two strips in this area, thereby facilitating the insertion and removal of a data element while minimizing the potential for scratching the fragile surface of a data element such as a microfiche. As seen most clearly in FIG. 19, the spacing embossments 74 in adjacent strips are in a staggered relationship so that they do not nest in one another, while providing a spring-loaded compressability.

As also clearly shown in FIG. 16, the spot welds 154 between adjacent strips are located in a longitudinal column along the horizontal tabs 179 just outwardly of the lower bend 178. This location provides added strength and resistance to tearing in that the sloping portion 176 of the upper margin and the lower bend 178 will form a flexing joint in the strip when the upper flap 32 is pulled away from the panel during the insertion or removal of a data element. The spot welds 154 are each located on the upper portion 186 of the lower strip and the lower portion 188 of an upper strip so as to seal the pockets while insuring a sealing between only two adjacent strips.

Details of the spot weld 128 between the strips and the pocket forming straps 42 are also shown clearly in FIG. 16. As previously mentioned, it is important that the spot weld 128 between the margin strip and a strap 42 be made as close to the vertex of the strap as possible so as to minimize the length of a tab 192 at the upper extremity of the vertex of the strap 42. It is crucial that the tab 192 be as small as possible, since the tab 192 presents an obstacle which can interfere with the insertion of a data element, and minimizing the length of the tab 192 minimizes this obstacle and the resultant interference with the insertion procedure. However, as shown (for illustrative purposes only) in conjunction with the lower-most spot weld 128 in FIG. 16, it is possible to eliminate the tab 192 entirely by forming the straps with the configuration of a modified strap 42' which is formed with a cut-out portion 194 just above the upper edge 196 of the vertex of the next lower strap. This allows the spot weld 128 to overlap the edge 196 thereby totally eliminating the tab 192. This feature is also illustrated in cross section in FIG. 18. If this latter strap configuration, i.e., that of the strap 42', is adopted, the need for the guiding embossments 76 is essentially eliminated, and the strips 26 may be conveniently made without them.

While the spot weld 128 between the strips and straps 142 is utilized in the preferred embodiment, those skilled in this art will recognize that other forms of attachment may be used. Alternately, the straps 142 may be simply interposed between pairs of strips, to extend above the lower of the strip pair, obviating the need for any attachment.

What is claimed is:

1. A device for the storage of flat, flexible data elements, comprising:

a plurality of horizontal strips of resilient material arranged to form a layered panel, at least some of said strips each having an upper margin which overlaps a portion of an adjacent strip in said panel; and a flexible sheet underlying and attached to said panel and having a plurality of inverted "V"-shaped cuts forming a plurality of inverted "V"-shaped straps, at least some of said straps each having a vertex attached to one of said strips below said overlapping upper margin, each of said straps which is attached to an adjacent strip being attached at an attachment point, each of said strips which is attached to one of said straps including means for guiding said data element over said attachment point.

2. The device of claim 2 wherein said guiding means is a protuberance in said strip above said attachment point.

3. A device for storing flat, flexible data elements, comprising:

a panel of overlapping pocket entrances each comprising a pair of vertically spaced, horizontally extending resilient strips one of said pair of strips having an upper margin overlapping a portion of the other of said pair of strips, said panel having a plurality of single thickness areas between overlapped portions of adjacent strips wherein the thickness of said panel equals the thickness of one of said strips; and a sheet having plural straps, at least some of said straps each being attached to said panel at one of said single thickness areas to form plural data element pockets.

4. The device of claim 3, wherein said straps are inverted "V"-shaped.

5. The device of claim 3, further comprising an additional plurality of single thickness areas proximate the lateral margins of said panel.

6. A device for the storage of flat, flexible data elements, comprising:

an array of plural horizontal strips in a vertically overlapping arrangement;

means attached to at least some of the strips in said array for forming a pocket between two adjacent strips; and means for providing a space between adjacent strips in said array.

7. The device of claim 6, wherein said space-providing means comprises an embossment on at least some of said strips, said embossment abutting against a non-embossed portion of an adjacent strip.

8. The device of claim 6, wherein said pocket-forming means comprises:

an array of plural straps, with adjacent straps in said array attached to adjacent strips in said array of strips to form a pocket therebetween.

9. The device of claim 8, wherein each of said straps has a vertex at which said strap is attached to one of said strips.

10. A device for storing flat, flexible data elements, comprising:

a panel having plural transverse strips in a parallel, vertically overlapping alignment, at least some of said strips have a lower margin with an upwardly indented central portion therein, said indented portion defining an area in said panel having a thickness equal to the thickness of a single strip; and a support sheet having plural straps, at least some of said straps each attached to one of said strips in one of said areas defined by said indented portion to form a pocket extending below adjacent strips.

11. The device of claim 10, wherein said strips are attached to each other proximate the lateral margins thereof.

12. The device of claim 10, wherein said indented portion has an obtuse angular configuration.

13. A device for the storage of flat, flexible data elements, comprising:

a panel having plural parallel transverse strips, at least some of said strips having an upper margin which overlaps a portion of an adjacent strip in said panel;

a flexible sheet underlying said panel and having a plurality of pocket-forming straps, each of said straps being attached at an attachment point to an overlying strip to define a pocket entrance between adjacent strips in said panel and a pocket between adjacent straps in said sheet; and means for guiding a data element over said attachment point and into said pockets.

14. The device of claim 13, wherein said guiding means is a cut-out portion in one of said straps upwardly adjacent to said attachment point.

15. The device of claim 13, wherein said guiding means is a protuberance in said overlying strip proximate said attachment point.

16. The device in claim 13, further comprising means for providing a flexing joint for at least a substantial portion of said upper margin of said strips when said portion of said upper margin is urged away from said panel.

17. The device of claim 16, wherein said joint providing means is a bend in said strips proximate the lateral margins thereof.

18. The device of claim 13, wherein each of said pocket-forming straps is attached to said overlying strip at a vertex in said strap.

19. The device of claim 13, wherein said attachment point is in an area of said panel having a thickness equal to the thickness of one of said strips.

20. The device of claim 13, wherein said straps are formed in said sheet by a plurality of vertically spaced angular cuts in said sheet.

21. The device of claim 20, wherein said sheet includes means for inhibiting the tearing of said straps.

22. The device of claim 21, wherein said tearing inhibiting means is an arcuate termination of said angular cuts.

23. The device of claim 13, further comprising means on said strips for inhibiting the tearing of said strips from said panel.

24. The device of claim 13, wherein said tearing inhibiting means is a bond between adjacent strips proximate the lateral margins thereof.

25. The device of claim 24, wherein said bond is between only two adjacent strips.

26. The device of claim 13, further comprising means for spacing apart adjacent strips in said panel.

27. The device of claim 25, wherein said spacing means is a protuberance in the lateral margins of at least some of said strips, said protuberance abutting against a planar portion of an adjacent strip.

* * * * *